US005405051A

United States Patent [19]

Miskell

[11] Patent Number: 5,405,051

[45] Date of Patent: Apr. 11, 1995

[54] TWO-PART AEROSOL DISPENSER EMPLOYING PUNCTURABLE MEMBRANES

[76] Inventor: David L. Miskell, 14571 Baumhart Rd., Oberlin, Ohio 44074-9618

[21] Appl. No.: 129,415

[22] Filed: Sep. 30, 1993

[51] Int. Cl.[6] ..... B65D 83/14

[52] U.S. Cl. ..... 222/23; 222/88; 222/145.1; 222/399; 222/153.06

[58] Field of Search ..... 222/23, 82, 83, 83.5, 222/88, 145, 394, 399

[56] References Cited

U.S. PATENT DOCUMENTS

| | | | |
|---|---|---|---|
| 2,205,938 | 6/1946 | Ward | 222/83 X |
| 2,893,603 | 7/1959 | Franck | 222/83 |
| 3,181,737 | 5/1965 | Chaucer | 222/136 |
| 3,191,808 | 6/1965 | Spalazzi et al. | 222/82 |
| 3,291,348 | 12/1966 | Chibret et al. | 222/145 |
| 3,314,571 | 4/1967 | Greenebaum | 222/135 |
| 3,343,718 | 9/1967 | Siegel et al. | 222/1 |
| 3,443,726 | 5/1969 | Muller et al. | 222/145 X |
| 3,556,171 | 1/1971 | Gangwisch et al. | 141/3 |
| 3,648,899 | 3/1972 | Lukesch et al. | 222/82 |
| 3,698,453 | 10/1972 | Morane et al. | 141/349 |
| 3,730,392 | 5/1973 | Marand | 222/82 |
| 3,809,289 | 5/1975 | Komendowski | 222/83 |
| 3,817,297 | 6/1974 | King | 141/20 |
| 3,937,367 | 2/1976 | Hood | 222/399 |
| 4,146,153 | 3/1979 | Bailen | 222/83 |
| 4,296,786 | 10/1981 | Brignola | 222/83.5 X |
| 4,988,017 | 1/1991 | Schrader et al. | 222/130 |

*Primary Examiner*—Andres Kashnikow
*Assistant Examiner*—Kenneth Bomberg
*Attorney, Agent, or Firm*—Rankin, Hill, Lewis & Clark

[57] ABSTRACT

Two-part reactive polymeric coatings are prepared and applied from an integral dispensing system. The reactive components are held in two separate containers held together by a coupling. Each container is sealed by a pierceable membrane. A piercing tube is disposed within the coupling. In use, the containers are twisted together to cause the tube within the coupling to pierce each of the membranes. Breakaway tabs protect against inadvertent displacement of the containers and provides a clear indication of whether the tube has pierced the membranes. Differential pressure between the containers causes the components to mix and begin to react; a net positive pressure with respect to the ambient atmosphere permits the mixed components to be applied as a spray. An externally mounted spray feed tube provides great flexibility in application of the paint being sprayed.

14 Claims, 4 Drawing Sheets

TWO-PART AEROSOL DISPENSER EMPLOYING PUNCTURABLE MEMBRANES

BACKGROUND OF THE INVENTION

1. Field of the Invention

The invention relates to spray cans for dispensing paint and, more particularly, to a dispenser in which a pressurized reactive component such as a dihydroxyl curing agent is stored in one can, and solvent, isocyanate catalyst and propellant are stored in another can. The components of the two cans are maintained separately until needed, at which time a seal between them is broken by a valve within a threaded coupling.

2. Description of the Prior Art

Automotive paint spraying systems for small-scale restoration of the finish of older vehicles or to repair nicks and scratches have been known for many years. The familiar spray paint can is simply a rolled metal can filled with pressurized propellant and a previously cured thermoset paint or coating which has been pulverized into very small particulates and suspended in a solvent. After being sprayed onto the part surface, the solvent is allowed to evaporate, leaving a dry, hard paint layer.

While this is a convenient and inexpensive application method, the paint layer being applied does not approach the level of durability and protection of which the thermoset coating material is capable. This is because the thermoset particulates that make up the paint layer are only softened by the solvent and not actually dissolved. The resulting paint layer is thus made up of tiny overlapping paint chips. While they are stuck together sufficiently to give an apparently uniform surface, the surface is in fact discontinuous at a microscopic scale. The surface thus lacks integrity at the microscopic scale, limiting durability, and the residual porosity permits environmental agents to penetrate to the substrate.

To achieve a continuous thermoset paint surface, such as that applied by original equipment manufacturers, chemically reactive components must be applied so as to cure seamlessly on the part surface itself. Such familiar paints as epoxies, polyurethanes, and polyacrylamides generally require mixing a pigmented reactive constituent with a catalyst or curing agent which initiates the thermosetting reaction. The reacting mixture is then sprayed under pressure from a compressor onto the surface to be painted, where both chemical reaction and solvent evaporation take place.

While the paint layer so applied demonstrates superior durability and imparts improved weather and corrosion resistance to the substrate, this application mode has several limitations. Because the reaction takes place quickly, and generally runs to completion once begun, application of reactive systems often involves fairly rigorous storage precautions, careful application preparation, and solvent-intensive clean-up procedures. Moreover, the chemical reactants themselves often may only be purchased in bulk, at least relative to the amount of paint needed to repair the usual scratches and nicks a home do-it-yourselfer would be repainting. In addition, such multi-constituent paint application also requires mixing componentry such as a spray gun and a compressor, with their attendant cost of rental or purchase.

Several attempts have been made to match the convenience of a small spray can dispenser with the durability and protection of a reactive system. These systems generally involve linking separate, differentially pressurized canisters containing the reactive species by means of valves which permit the constituents to be mixed together just prior to application. Such an arrangement permits better coatings to be applied from more convenient, disposable dispensers.

Such systems include those described in U.S. Pat. No. 3,181,737 to Chaucer, U.S. Pat. No. 3,343,718 to Siegel et at., U.S. Pat. No. 3,698,453 to Morane et al., and U.S. Pat. No. 4,988,017 to Schrader et al. In these devices, a vessel containing fluid under higher pressure is coupled through one or more mechanically operated valves to a vessel under lower pressure. These mechanical valves generally include many components, some of which require close tolerances and detailed machining. Upon activating the valves, the higher pressure fluid is transferred into the lower pressure container, from which the mixture of the two fluids can be sprayed.

While these two-canister systems offer superior coating potential, they have relatively complicated coupling valves, which add unnecessary cost to the system. Somewhat simpler valves are disclosed in U.S. Pat. No. 3,556,171 to Gangwisch et al., U.S. Pat. No. 3,314,571 to Greenebaum, and U.S. Pat. No. 3,817,297 to King, each of which discloses a re-tillable aerosol system. These latter systems, however, do not provide for the mixing of multiple constituents. Instead, they are intended to provide storage quantities of perfume, for example, that can be used to replenish smaller dispenser canisters.

Desirably, an aerosol paint dispenser for home or shop use by the do-it-yourselfer should be compact to reflect the generally limited amount of paint needed for the ordinary use to which it is put. The dispenser also should allow the application of reactive constituents to provide a coating which is physically and chemically superior to those of common spray paints. Further, the dispenser should provide means of assuring that the constituents are kept separate from each other until needed for use. The dispenser package also should be sufficiently inexpensive and simple to use so that it will be purchased and used by as many consumers as possible.

SUMMARY OF THE INVENTION

In response to the foregoing concerns, the present invention provides a new and improved two-part aerosol dispenser. The dispenser according to the present invention includes two sealed containers, each of which contains reactive constituents. The containers are joined by a threaded valve body. A bayonet-type valve is disposed within the valve body. Each container is sealed by a puncturable membrane which is readily pierced by the valve upon screwing the containers together.

The dispenser according to the present invention includes break-away tabs that provide protection against inadvertent mixing by presenting a physical block to threadedly engaging the two containers. The position of the tabs provide an unambiguous indicator of whether the containers have been engaged, enabling the consumer to determine whether the product is still usable. The dispenser according to the present invention also includes a flexible tube for application of the mixed reactive constituents, to allow the consumer to apply paint in tight locations and internal areas for greatest substrate protection.

The dispenser according to the present invention is exceedingly inexpensive and easy to manufacture relative to other two-component aerosol dispensers. It is simple to operate, allowing the preparation of highly durable and chemically resistant coatings to be applied by merely turning the two containers about their mutual axis. The dispenser according to the present invention also is convenient, as it lets the consumer know whether or not the contents of the paint dispenser are still fresh. Further, it is more versatile than even conventional single-component spray cans, because it has a long neck to allow spraying into close quarters that conventional spray nozzles cannot reach.

The foregoing and other features and advantages of the present invention are illustrated in the accompanying drawings and are described in more detail in the specification and claims that follow.

DESCRIPTION OF THE PREFERRED EMBODIMENT

Figure 1:
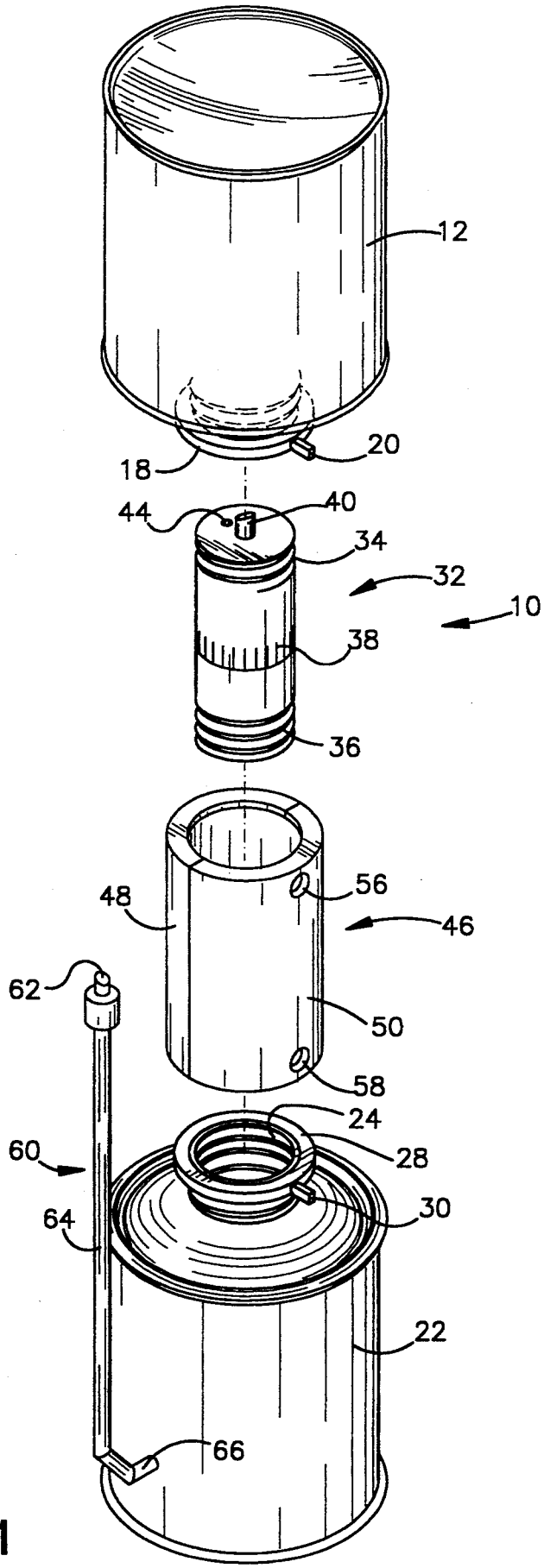
FIG. 1 is a perspective, exploded view of an aerosol dispenser according to the present invention.
Figure 2:
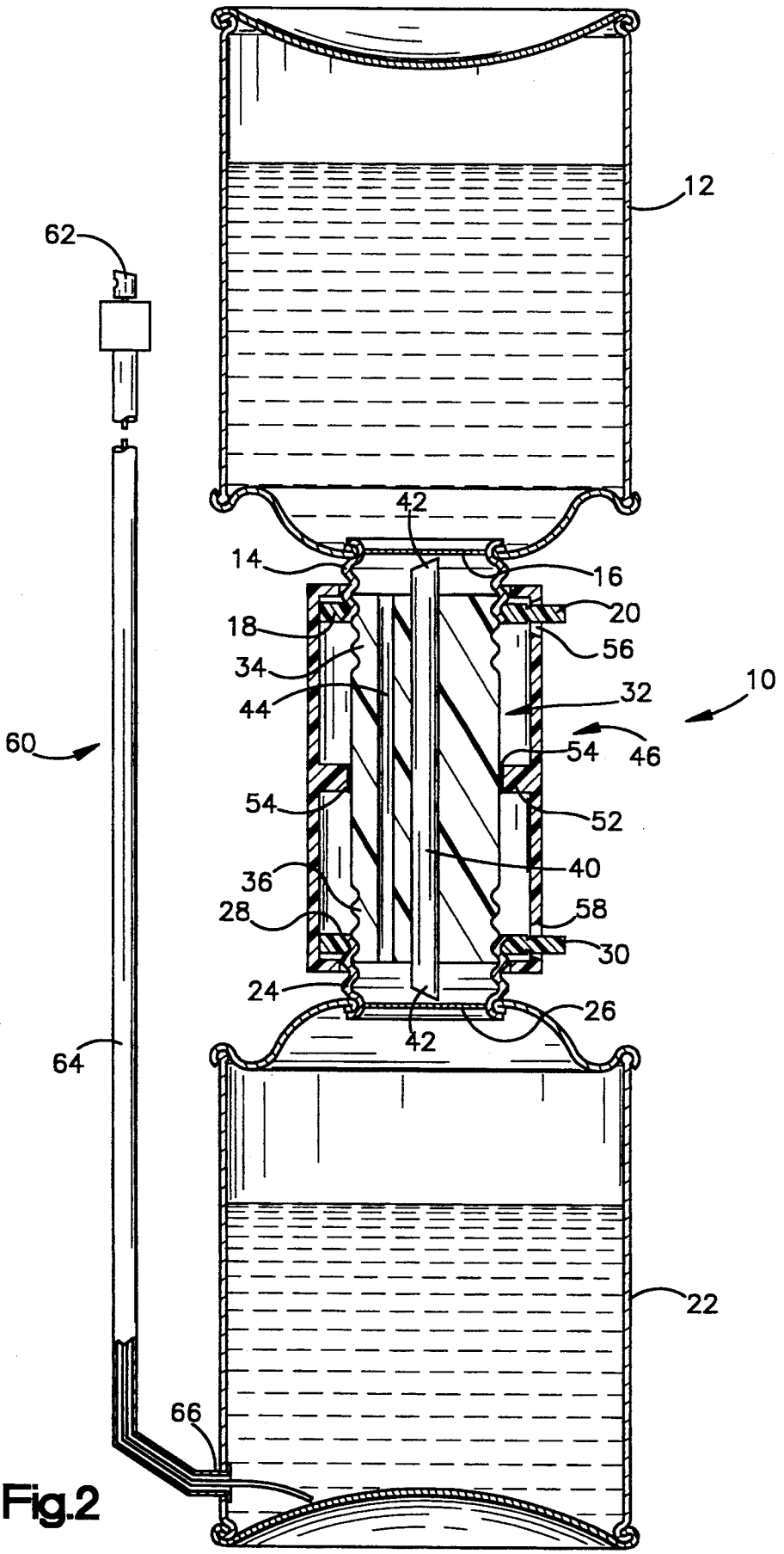
FIG. 2 is a cross-sectional view of the dispenser according to the invention, with two containers and a valve body assembled and positioned for transport and storage.
Figure 3:
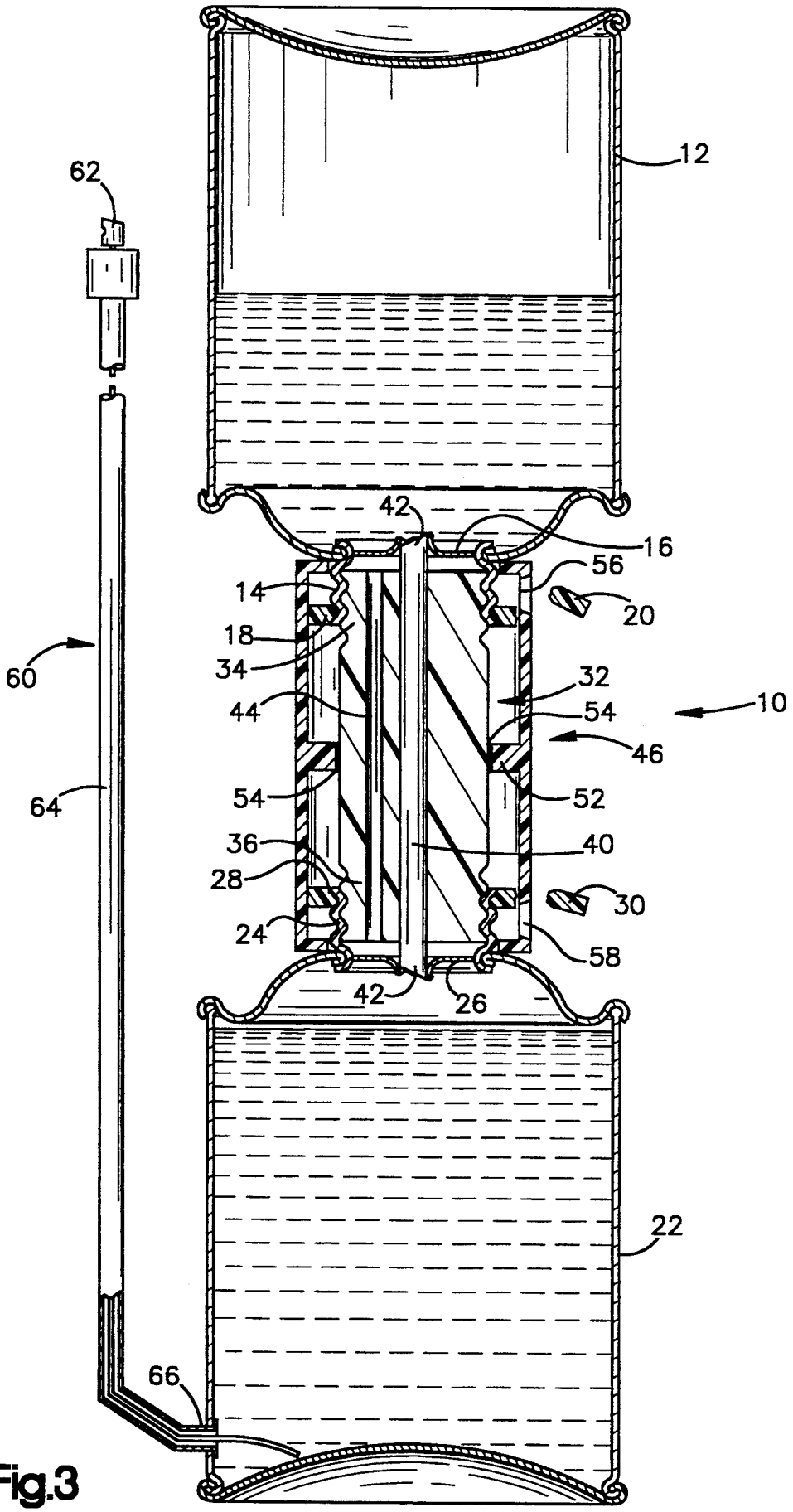
FIG. 3 is a view similar to FIG. 2 showing the containers and valve body ready for use.

Referring to FIGS. 1–3, an aerosol dispenser according to the invention is indicated generally by the reference numeral 10. The dispenser 10 is particularly effective for the storage and dispensing of polymerizable paint and the description herein will be with respect to such an application. It is to be understood, however, that the dispenser 10 can be used to dispense any two-part liquid or gaseous composition suitable for spraying.

The dispenser 10 includes a first container 12 having a threaded neck 14. A seal, or membrane 16, extends across the opening defined by the neck 14 so as to provide a seal for the container 12. The container 12 is formed from metal using conventional stamping, drawing, and roll-forming techniques. The membrane 16 is formed from polyethylene terephthalate (PET) or polyurethane (PU) film, aluminum, tin foil, or thin-gauge steel.

A ring 18 is rigidly secured to the end of the neck 14. The ring 18 includes a breakaway tab 20 that extends radially outwardly from the ring 18. The ring 18 with its breakaway tab 20 are cast from zinc or aluminum, or molded from acetal, acrylonitrile butadiene styrene (ABS) or polystyrene (PS). The ring 18 is rigidly attached to the neck 14 by any conventional technique such as gluing, ultrasonic welding, and the like.

The dispenser 10 includes a second container 22 having a threaded neck 24. The ring 28 includes a breakaway tab 30 that extends radially outwardly from the ring 28. The ring 28 with its breakaway tab 30 are cast from zinc or aluminum, or molded from acetal, acrylonitrile butadiene styrene (ABS) or polystyrene (PS). The ring 28 is rigidly attached to the neck 24 by any conventional technique such as gluing, ultrasonic welding, and the like.

The dispenser 10 includes a cylindrical valve body 32 that provides a rigid connection between the containers 12, 22, as well as fluid communication therebetween. The valve body 32 includes a first, threaded end 34 and a second, threaded end 36. A plurality of splines 38 are disposed circumferentially about the midpoint of the valve body 32. The valve body 32 includes a longitudinally extending hollow tube 40 that is rigidly secured within the valve body 32. The tube 40 includes sharp, beveled ends 42. The valve body 32 also is provided with a longitudinally extending bore 44 that is parallel with the tube 40.

A sleeve 46 is disposed about the valve body 32. The sleeve 46 is made of a plastics material such as ABS, or a metal such as aluminum. The sleeve 46 includes a first part 48 and a second part 50. The first and second parts 48, 50 can be joined by any suitable technique such as gluing, ultrasonic welding, interlocking tabs, and the like. Referring particularly to FIGS. 2 and 3, the sleeve 46 includes a radially inwardly extending ledge 52 having a plurality of teeth 54. The teeth 54 are of a size and shape such that they will engage the splines 38 included as part of the valve body 32. The second part 50 includes a first opening 56 and a second opening 58. The openings 56, 58 are of a size and shape such that the tabs 20, 30, respectively, can extend therethrough.

The dispenser 10 includes a sprayer 60. The sprayer 60 includes a nozzle 62 and an elongate, flexible tube 64. The tube 64 is joined to the second container 22 near a lower portion thereof by means of flanged connection 66. The flanged connection 66 provides a fluidtight seal between the container 12 and the tube 64. The nozzle 62 and tube 64 are formed of plastics materials as is well known in the art. The techniques for forming the containers 12, 22 and for filling the interiors thereof with gas and liquid are conventional and do not need to be described here.

ASSEMBLY AND OPERATION

After the containers 12, 22 have been filled with desired gaseous and liquid constituents, the dispenser 10 is assembled and operated as follows:

1. The threaded end 34 is threaded into the neck 14 until the beveled end 42 attains that position shown in FIG. 2.
2. The neck 24 is threaded onto the threaded end 36 until the other beveled end 42 attains that position shown in FIG. 2.
3. The sleeve 46 is assembled about the valve body 32 by pressing the first and second parts 48, 50 together with the tabs 20, 30 extending through the openings 56, 58, respectively. After the sleeve 46 has been assembled, the teeth 54 will engage the splines 38 so as to prevent relative rotation between the sleeve 46 and the valve body 32.
4. Referring now to FIG. 3, when it is desired to use the dispenser 10 by mixing the contents of the containers 12, 22, the sleeve 46 is grasped by the user and the containers 12, 22 are rotated.
5. As the containers 12, 22 are rotated, the necks 14, 24 are advanced relative to the valve body 32. As rotation commences, the breakaway tabs 20, 30 are fractured.
6. As the containers 12, 22 are continued to be rotated, eventually the beveled ends 42 will pierce the membranes 16, 26. Rotation of the containers 12, 22 is continued until the threaded ends 34, 36 bottom out within the necks 14, 24, respectively. The bottomed out position of the threaded ends 34, 36 is illustrated in FIG. 3.

7. After the membranes 16, 26 have been punctured, the contents of container 12 will be forced into the container 22 under the influence of gas pressure and gravity.

Typically, the container 12 is filled partially with solvent, catalyst, and propellant. The container 22 typically is filled partially with solvent, paint base, and possibly propellant as well. If a polymerizable paint is being prepared for spraying, polymerization will start to occur immediately upon discharge of the contents of the container 12 into the container 22. Such discharge is facilitated by the bore 44 which provides pressure relief between the first and second containers 12, 22. After a short interval during which mixing is completed, the nozzle 62 can be actuated so as to spray paint that is in the process of being polymerized. Because the paint being sprayed is undergoing polymerization while spraying occurs, the finished paint surface will provide a hard, durable, uniform layer upon the evaporation of solvents, and propellants. The resultant finish will be far superior to that available through the use of conventional spray cans that employ pre-polymerized, pulverized paint constituents. After spraying has been completed, the dispenser 10 should be discarded because any unsprayed contents will form a solid mass, usually within 24 hours or less.

ALTERNATIVE EMBODIMENT

Figure 4:
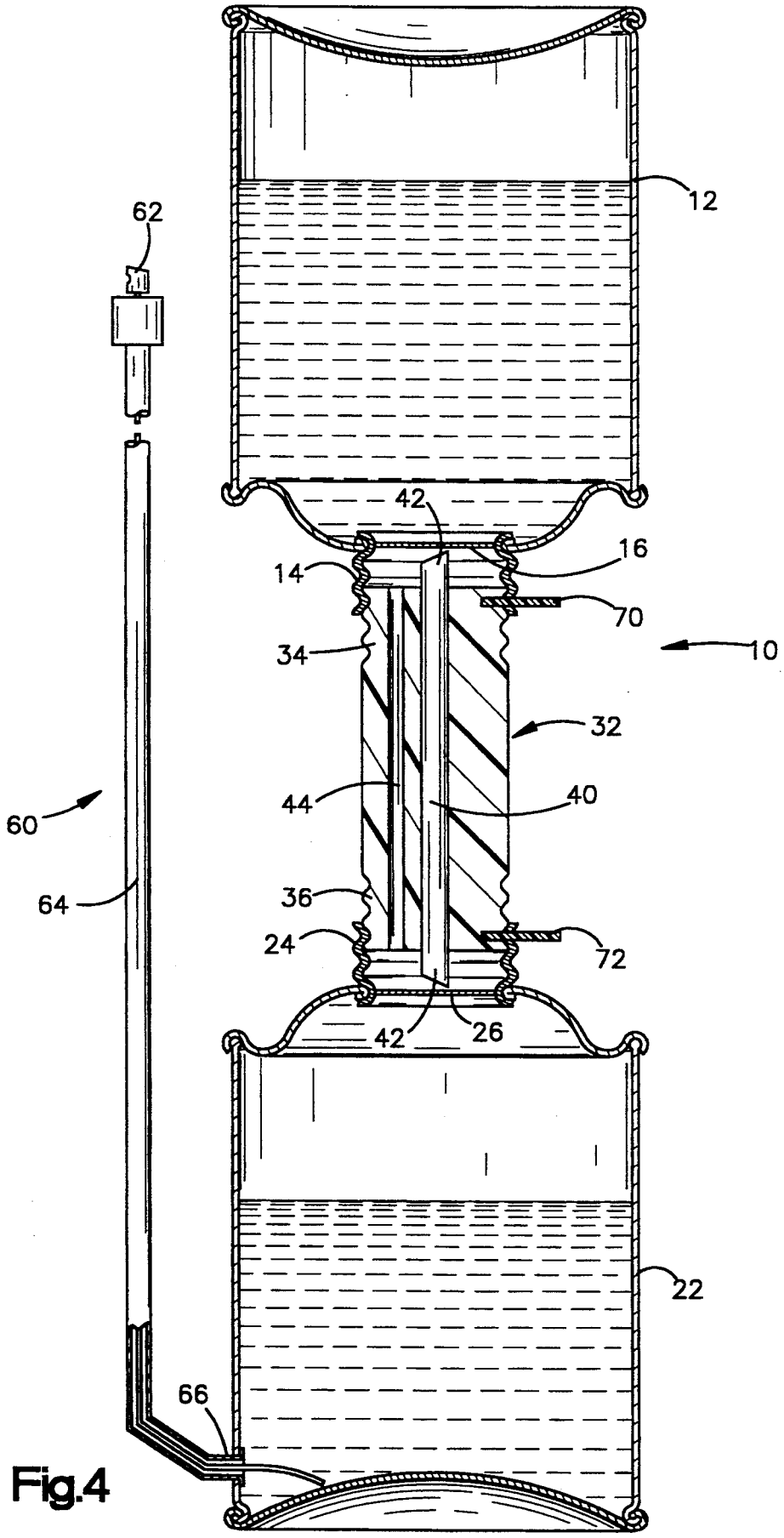
FIG. 4 is a view of an alternative technique for joining the containers used as part of the invention.

Referring now to FIG. 4, an alternative embodiment of the invention is shown. In this embodiment of the invention, the rings 18, 28 and the sleeve 46 have been eliminated and replaced by a pair of pins 70, 72 that extend through openings formed in the necks 14, 24 and the threaded ends 34, 36. The pins 70, 72 are made of a frangible material such as ABS or a suitable low-strength metal alloy that will fracture upon the application of shear force thereto.

It is expected that the openings in the necks 14, 24 and the threaded ends 34, 36 will be formed after the containers 12, 22 and the valve body 32 have been assembled to that position shown in FIG. 2. Upon inserting the pins 70, 72 into the openings thus formed, and after securing the pins 70, 72 therein (by suitable techniques such as gluing), any relative rotation between the containers 12, 22 and the valve body 32 will cause either or both of the pins 70, 72 to fracture. If such fracturing occurs before purchase, it will provide an indication to the potential purchaser that the dispenser 10 should not be purchased because mixing of the contents of the containers 12, 22 possibly has occurred.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A pressurized aerosol dispenser, comprising:

a first container sealed by a first pierceable membrane, the first container being charged with first constituents under pressure;

a second container sealed by a second pierceable membrane, the second container being charged with second constituents;

connecting means for connecting the first and second containers to each other so as to establish fluid communication therebetween upon the piercing of the membranes;

piercing means associated with said connecting means for piercing the membranes when desired and permitting the first constituents to flow from the first container into the second container through the connection means;

indicator means associated with said connecting means for indicating whether the first and second membranes have been pierced; and sprayer means connected to one of said first or second containers for dispensing the mixed first and second constituents from the second container.

2. The dispenser of claim 1, wherein the first and second membranes are formed from a plastics material selected from the group consisting of polyethylene terephthalate and polyurethane.

3. The dispenser of claim 1, wherein the first and second membranes are formed of a metal selected from the group consisting of aluminum, tin, and steel.

4. The dispenser of claim 1, wherein:

the first and second containers each include a threaded neck, and the first and second membranes are disposed adjacent the respective necks; and the connecting means is in the form of a valve body having threaded ends engageable with the necks.

5. The dispenser of claim 4, wherein the piercing means is in the form of a hollow tube rigidly mounted within the valve body and extending therethrough, the ends of the tube being of a configuration such that the ends will pierce the first and second membranes upon engagement therewith.

6. The dispenser of claim 4, wherein the indicator means for indicating whether the membranes have been pierced, comprises:

aligned openings formed in each of the first and second necks and the valve body; and a frangible pin disposed in each of the aligned openings whereby, upon rotation of the first and second containers relative to the valve body, the pins will be broken away.

7. The dispenser of claim 4, wherein the indicator means includes:

a first breakaway tab connected to the neck of the first container and extending radially outwardly therefrom;

a second breakaway tab connected to the neck of the second container and extending radially outwardly therefrom; and a sleeve disposed about the valve body and rigidly connected thereto, the sleeve including openings through which the first and second tabs extend, whereby, upon rotation of either the first container or the second container relative to the sleeve, the first and second tabs will be broken away.

8. The dispenser of claim 7, wherein the first and second tabs are formed from a metal selected from the group consisting of zinc and aluminum.

9. The dispenser of claim 7, wherein the first and second tabs are formed from a plastics material selected from the group consisting of acetal, acrylonitrile butadiene styrene, and polystyrene.

10. A pressurized aerosol dispenser comprising:

a first container having a first threaded neck, the first container being sealed by a first pierceable membrane disposed adjacent the first threaded neck, the first container being charged with first constituents under pressure;

a second container having a second threaded neck, the second container being sealed by a second pierceable membrane disposed adjacent the second threaded neck, the second container being charged with second constituents;

connecting means in the form of a valve body for connecting the first and second containers to each other so as to establish fluid communication therebetween upon piercing of the first and second membranes, the valve body having threaded ends engageable with the first and second threaded necks;

an elongate, hollow tube rigidly disposed within the valve body and projecting from the ends thereof, the tube having ends of a configuration suitable for piercing the first and second membranes when desired, the tube permitting the first constituents to flow from the first container into the second container;

an elongate bore disposed in the valve body, the bore being spaced from the hollow tube; and sprayer means for dispensing mixed first and second constituents from the second container, the sprayer means including a nozzle, an elongate, flexible tube, and a fluidtight connection between the tube and the second container.

11. The dispenser of claim 10, further including indicator means for indicating whether the membranes have been pierced, comprising:

a first breakaway tab connected to the neck of the first container and extending radially outwardly therefrom;

a second breakaway tab connected to the neck of the second container and extending radially outwardly therefrom; and a sleeve disposed about the valve body and rigidly connected thereto, the sleeve including openings through which the first and second tabs extend, whereby, upon rotation of either the first container or the second container relative to the sleeve, the first and second tabs will be broken away.

12. The dispenser of claim 11, wherein the first and second tabs are formed from a metal selected from the group consisting of zinc and aluminum.

13. The dispenser of claim 11, wherein the first and second tabs are formed from a plastics material selected from the group consisting of acetal, acrylonitrile butadiene styrene, and polystyrene.

14. The dispenser of claim 10, further comprising indicator means for indicating whether the membranes have been pierced, comprising:

aligned openings formed in each of the first and second necks and the valve body; and a frangible pin disposed in each of the aligned openings whereby, upon rotation of the first and second containers relative to the valve body, the pins will be broken away.

* * * * *

UNITED STATES PATENT AND TRADEMARK OFFICE

CERTIFICATE OF CORRECTION

PATENT NO. : 5,405,051

DATED : April 11, 1995

INVENTOR(S) : David L. Miskell

It is certified that error appears in the above-indentified patent and that said Letters Patent is hereby corrected as shown below:

Column 2, line 25, "re-tillable" should be corrected to read --re-fillable--.

Signed and Sealed this

Third Day of October, 1995

Bruce Lehman

*Attest:*

BRUCE LEHMAN

*Attesting Officer*

*Commissioner of Patents and Trademarks*